US007278956B1

(12) United States Patent
Chen

(10) Patent No.: US 7,278,956 B1
(45) Date of Patent: Oct. 9, 2007

(54) PEDALING EXERCISER WITH A TWISTER DEVICE

(76) Inventor: Neng-Ching Chen, No. 14, Alley 17, Ln. 56, Kuoan St., Annan, Tainan (TW)

( * ) Notice: Subject to any disclaimer, the term of this patent is extended or adjusted under 35 U.S.C. 154(b) by 14 days.

(21) Appl. No.: 11/381,635

(22) Filed: May 4, 2006

(51) Int. Cl.
*A63B 22/06* (2006.01)

(52) U.S. Cl. ..... 482/57; 472/21

(58) Field of Classification Search ..... 482/51, 482/52, 57, 138, 142, 146–148; 472/1, 6, 472/14, 16, 21, 30, 35, 40
See application file for complete search history.

(56) References Cited

U.S. PATENT DOCUMENTS 3,441,271 A * 4/1969 Palacios ..... 482/146
3,612,519 A * 10/1971 Larson ..... 482/147
3,911,907 A * 10/1975 Smith, Jr. ..... 482/1
4,291,873 A * 9/1981 Lee et al. ..... 482/147
4,629,181 A * 12/1986 Krive ..... 482/71
5,366,430 A * 11/1994 Yao ..... 482/147
6,875,159 B2 * 4/2005 Chuang ..... 482/51
7,081,074 B1 * 7/2006 Rubin ..... 482/146
2006/0240950 A1 * 10/2006 Chang ..... 482/52
2007/0010377 A1 * 1/2007 Wu et al. ..... 482/61

* cited by examiner

*Primary Examiner*—Stephen R. Crow
*Assistant Examiner*—Tam Nguyen
(74) *Attorney, Agent, or Firm*—Alan Kamrath; Kamrath & Associates P.A.

(57) ABSTRACT

A pedaling exerciser with a twister device has a base, a twister device mounted on the base, a pedaling assembly combined with the twister device, and an optional shell covering crank drums of the pedaling assembly. The twister device is composed of an intermediate plate and a rotating plate mounted. The intermediate plate is secured on a central shaft of the base and has multiple balls rotatably mounted thereon. The rotating plate rotatably mounted on the intermediate plate and has a bearing attached thereon around the central shaft to keep the rotating plate stable during rotation. Moreover, the rotating plate has a pin assembly movably engaged the intermediate plate to lock the twister device. By having the twister device, the pedaling exerciser selectively works pedaling and twisting functions at the same time.

7 Claims, 11 Drawing Sheets

PEDALING EXERCISER WITH A TWISTER DEVICE

BACKGROUND OF THE INVENTION

1. Field of the Invention

The present invention relates to a pedaling exerciser, and more particularly to a pedaling exerciser that further has an optional twisting function.

2. Description of Related Art

A conventional pedaling exerciser available in the exercise equipment market only has one pedaling function to make a user exercise their legs by pedaling movement. However, the user easily gets bored to practice the tedious exercises continuously and can not get more extra benefits from the conventional pedaling exerciser.

SUMMARY OF THE INVENTION

A main objective of the present invention is to provide a pedaling exerciser that combines with a twister device to make operation of the pedaling exerciser versatile.

Another main objective of the present invention is to provide a pedaling exerciser that is stable during rotation.

To achieve the foregoing objectives, the pedaling exerciser with the twister device comprises:

a base having a top face, a circular sidewall formed on the top face to defined a recess and a central shaft erecting on the top face within the circular sidewall;

the twister device mounted on the base and having an intermediate plate received in the recess and penetrated and secured by the central shaft of the base and having multiple balls rotatably mounted on the intermediate plate to serve as friction-reducing elements; and a rotating plate rotatably mounted on the intermediate plate and correspondingly engaged the circular sidewall on the base;

a bearing attached to the central shaft on the base and combined to the rotating plate to make the rotating plate rotate stably; and a pedaling assembly mounted on the rotating plate to drive the rotating plate to rotate.

By combining the twister device with the pedaling assembly, the pedaling exerciser further has a twisting function for training waist.

Further benefits and advantages of the present invention will become apparent after a careful reading of the detailed description with appropriate reference to the accompanying drawings.

BRIEF DESCRIPTION OF THE DRAWINGS

FIG. 9-1 is an operationally enlarged cross-sectional view of a pin assembly as shown in FIG. 9, wherein the twister device is unlocked;

FIG. 9-2 is another operationally enlarged cross-sectional view of a pin assembly as shown in FIG. 9, wherein the twister device is locked.

DETAILED DESCRIPTION OF THE PREFERRED EMBODIMENT

A pedaling exerciser with a twister device in accordance with the present invention comprises a base, a twister device mounted on the base, a pedaling assembly combined with the twister device, and an optional shell covering crank drums. The twister device is composed of an intermediate plate and a rotating plate mounted. The intermediate plate is secured on a central shaft of the base and has multiple balls rotatably mounted thereon. The rotating plate rotatably mounted on the intermediate plate and has a bearing attached thereon around the central shaft to keep the rotating plate stable during rotation. Moreover, the rotating plate has a pin assembly movably engaged the intermediate plate to lock the twister device. By having the twister device, the pedaling exerciser selectively works pedaling and twisting functions at the same time.

Figure 1:
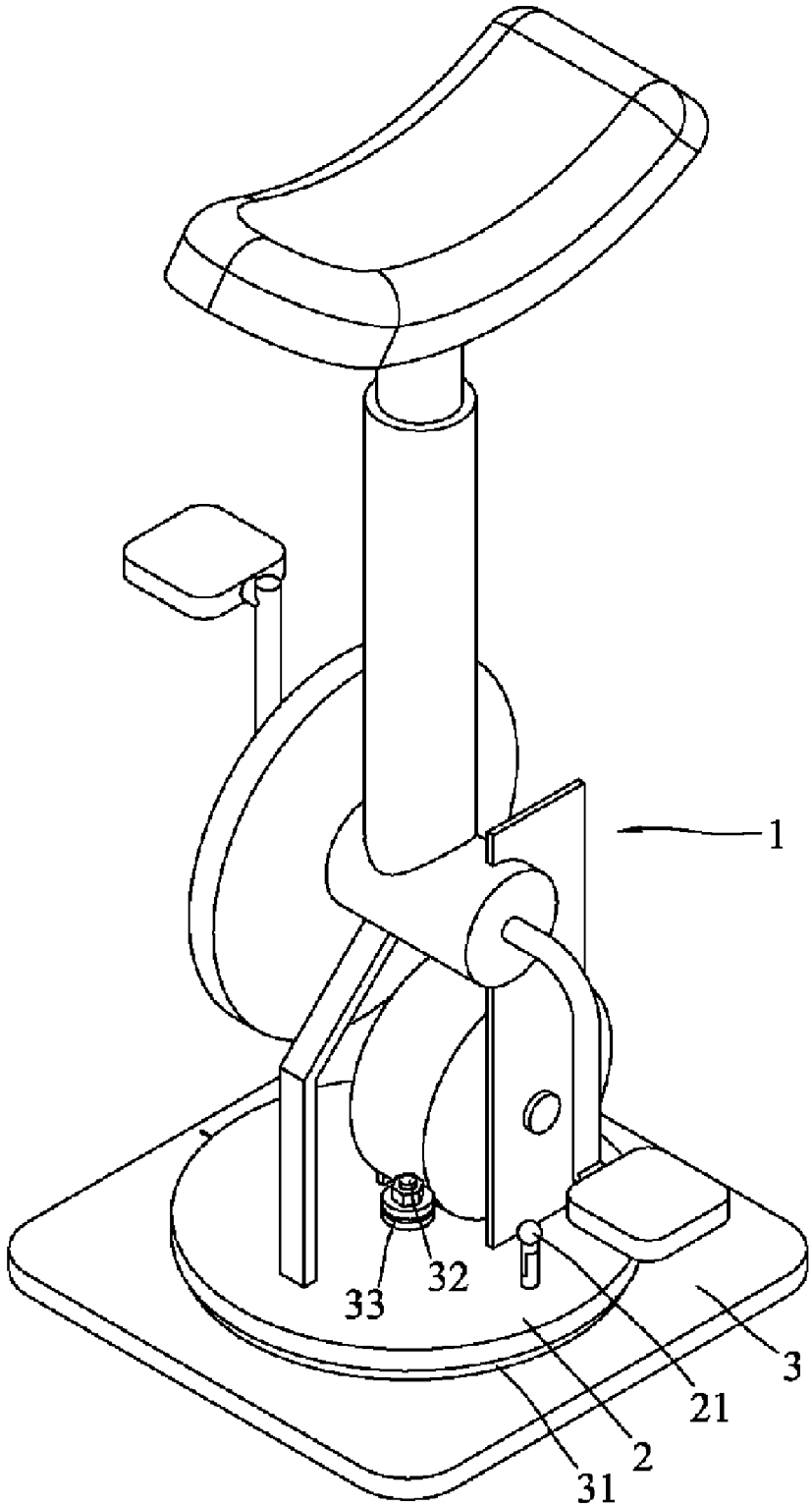
FIG. 1 is a perspective view of a pedaling exerciser with a twister device shown in a front left direction in accordance with the present invention.
Figure 2:
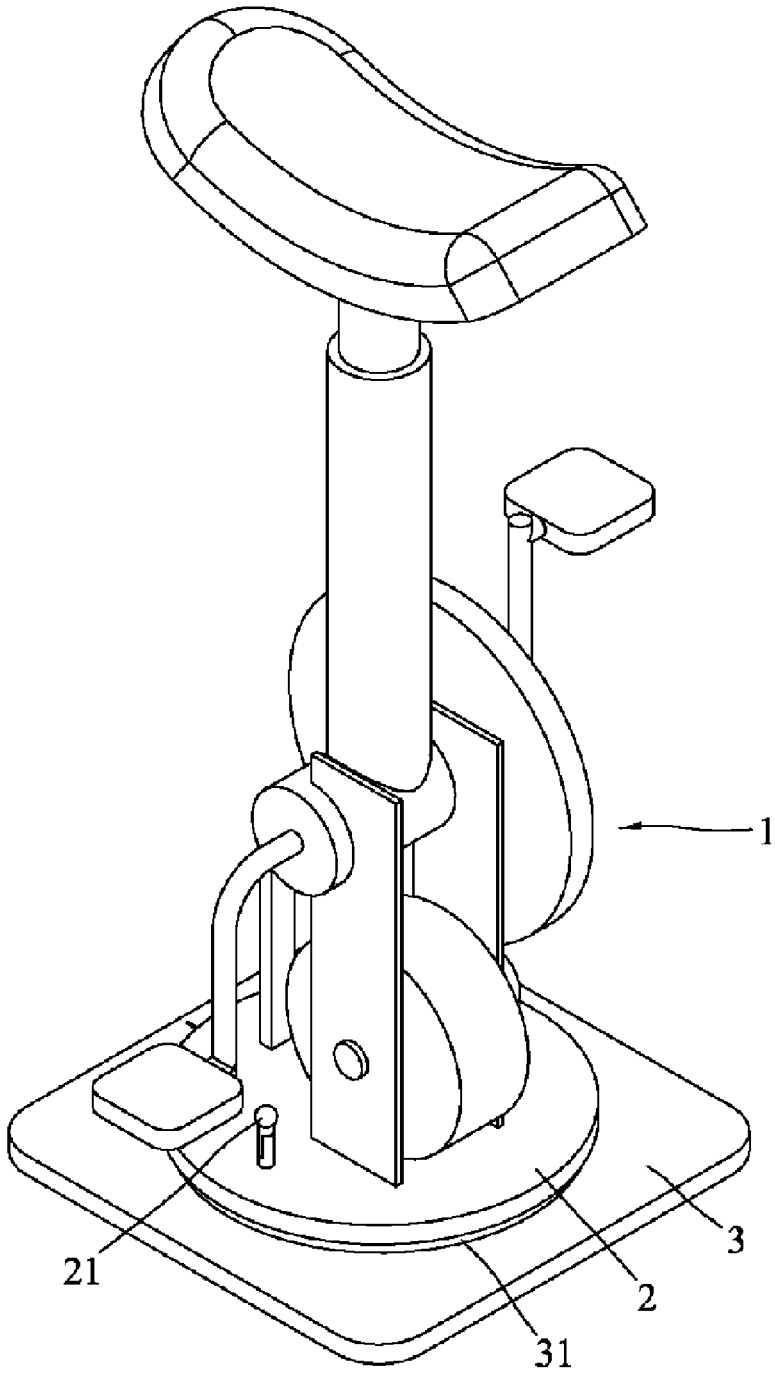
FIG. 2 is another perspective view of the pedaling exerciser with the twister device in FIG. 1 shown in a rear left direction.
Figure 3:
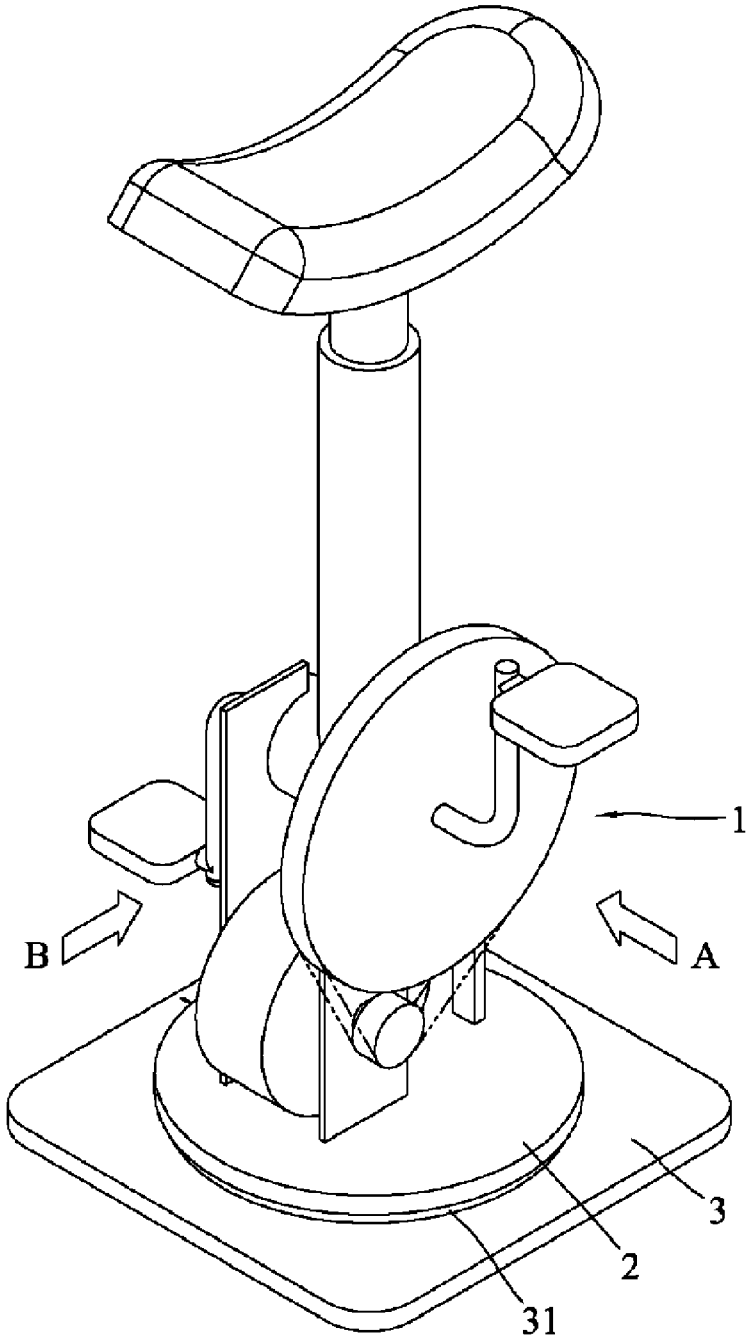
FIG. 3 is still another perspective view of the pedaling exerciser with the twister device in FIG. 1 shown in a rear right direction.

With reference to FIGS. 1 to 3, a preferred embodiment of the pedaling exerciser with the twister device comprises a pedaling assembly 1, a rotating plate 2, an intermediate plate (a), a base 3 and an optional shell 4.

Figure 10:
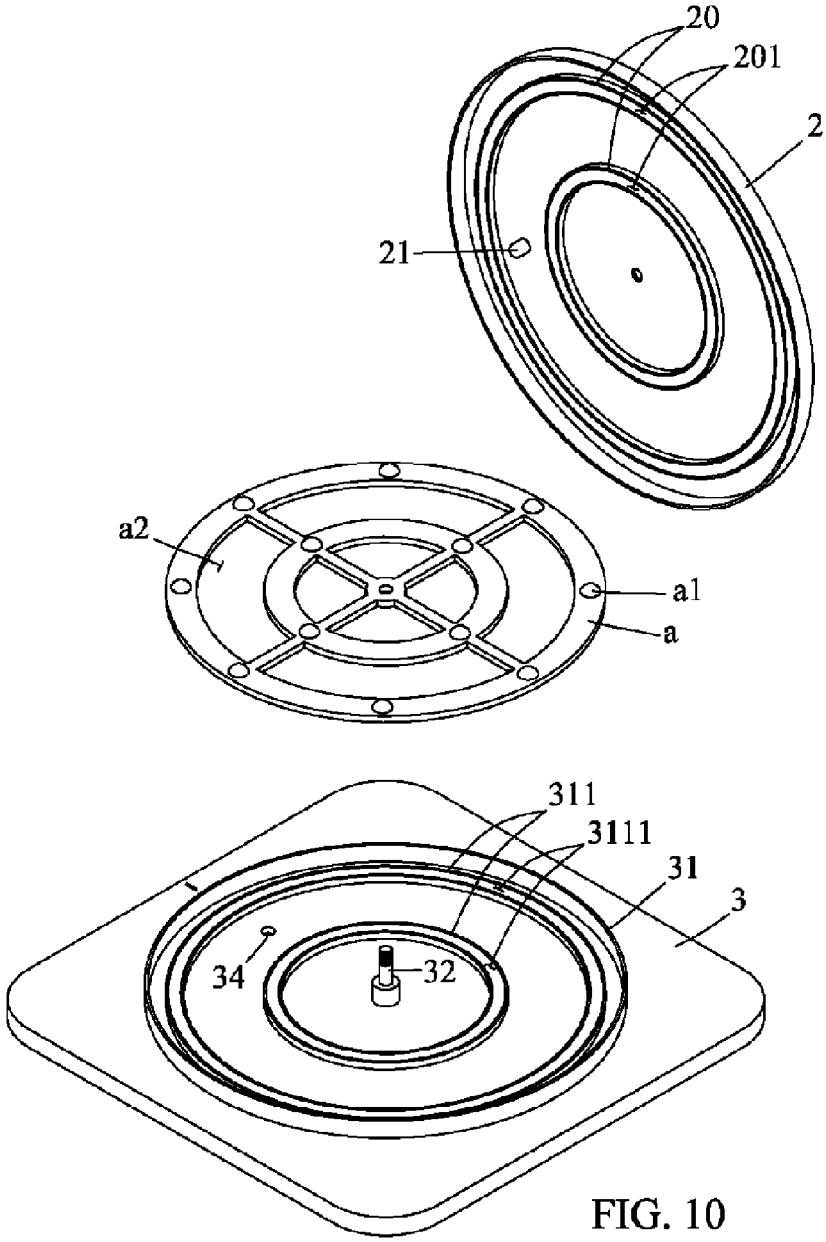
FIG. 10 is an exploded perspective of the twister device in FIG. 8.

Particularly as shown in FIG. 10, the base 3 is a rectangular board and has a circular sidewall 31 formed on the base 3 to define a recess with a center. A central shaft 32 erecting at the center of the recess and two circular tracks 311 are formed on the base 3 concentrically with the circular sidewall 31 within the recess. Each circular track 311 has a top and a shallow concave groove 3111 defined on the top thereof. Moreover, the base 3 further has a positioning hole 34 defined on the base 3 within the circular sidewall 31 (see FIG. 10).

Figure 8:
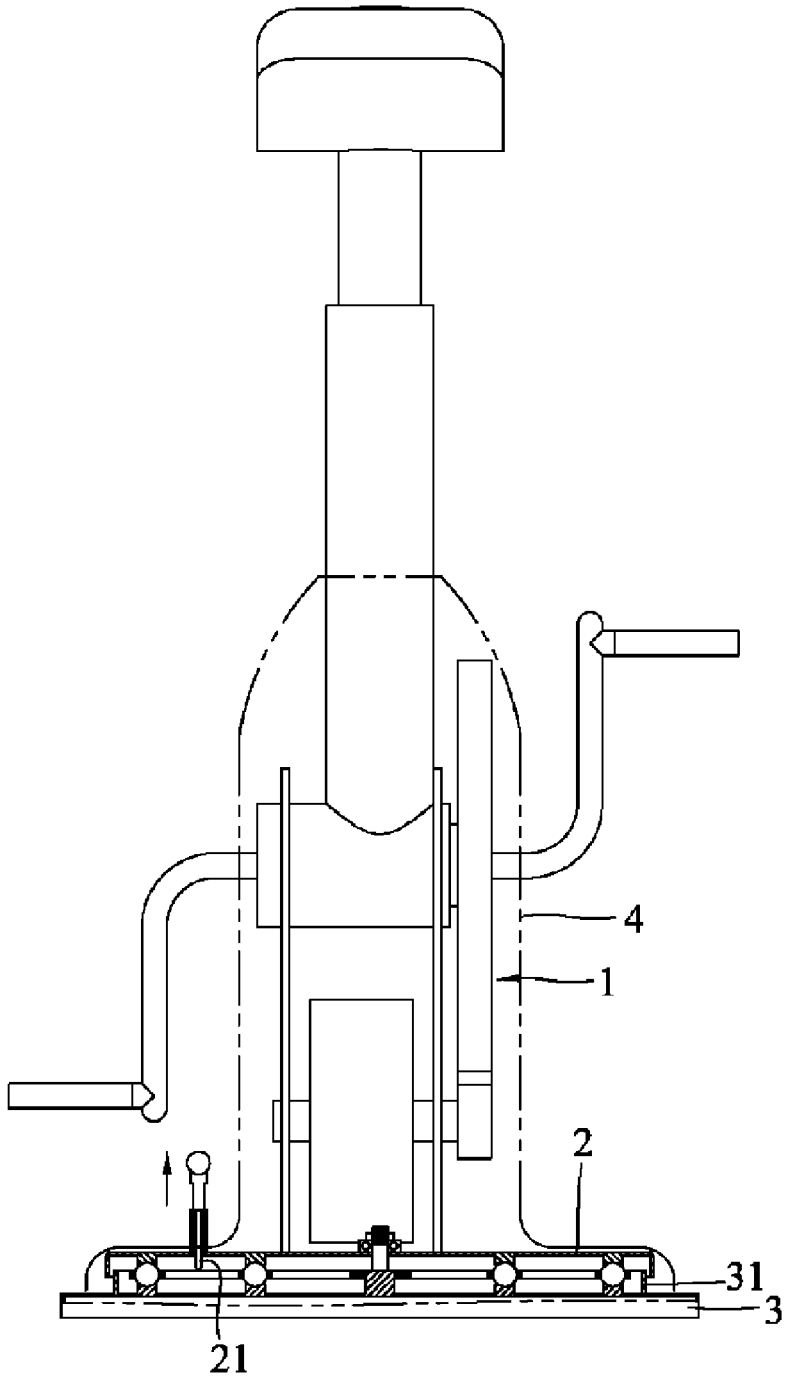
FIG. 8 is a cross-sectional side view of the twister device with a shell.
Figure 9:
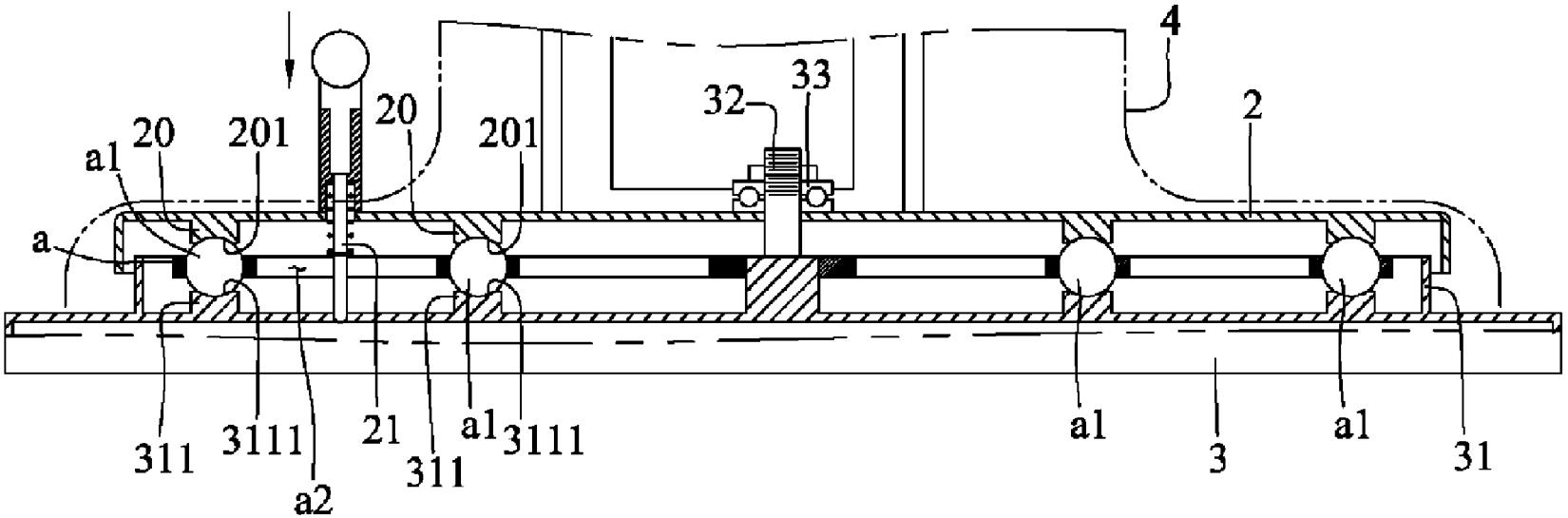
FIG. 9 is an operationally enlarged cross-sectional view of the twister device in FIG. 8, wherein the twister device is locked.
Figures 2, 9:
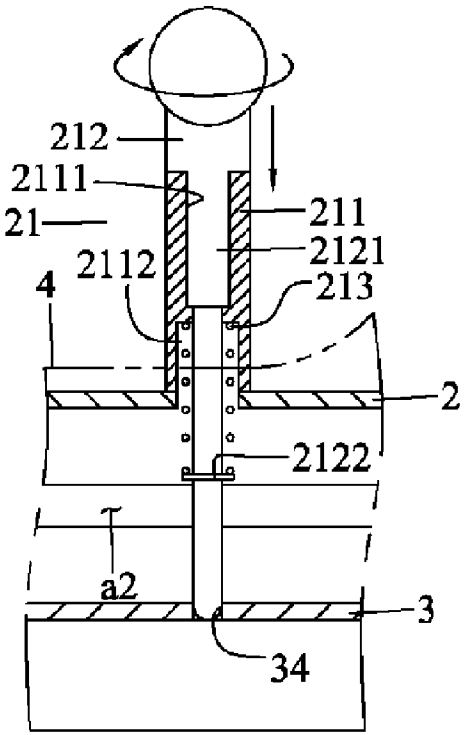
Figures 1, 9:
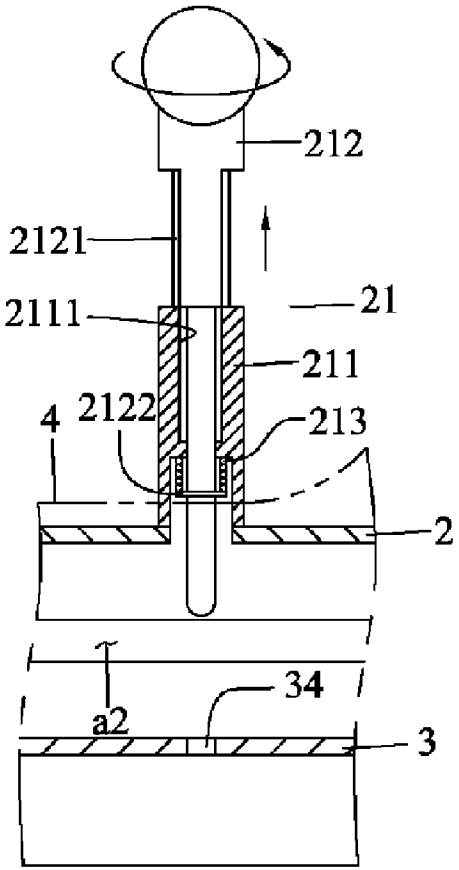

The twister device is composed of the rotating plate 2 and the intermediate plate (a) and mounted between the base 3 and the pedaling assembly as shown in FIGS. 8 and 9. The intermediate plate (a) is correspondingly received inside the recess and secured on the central shaft 32 of the base 3. Multiple balls (a1) are rotatably attached on the intermediate plate (a) to enable the rotating plate 2 to slide thereon, thereby, the twister device rotates in 360° rotation. Moreover, the intermediate plate (a) further has multiple annular ribs and radial ribs formed on surfaces to enhance the strength of the intermediate, wherein the multiple balls (a1) are attached at intersections of the annular ribs and radial ribs. The rotating plate 2 is round-shaped to correspondingly and rotatably engage the circular sidewall 31. Two circular tracks 20 are formed on a bottom face of the rotating plate 2 to align with the circular tracks 311 on the base 3. Each circular track 20 also has a top and a shallow concave groove 201 defined on the top thereof. Additionally, a pin assembly 21 is operationally mounted on the rotating plate 2 to selectively engage the base 3 to serve as a locking device.

The pin assembly 21 comprises a holding base 211, a pin shaft 212 and a resilient element. As shown in FIGS. 9-1 and 9-1, the holding base 211 is tubular and mounted on the rotating plate 2 and has an upper recess 2111 defined at its top and a spring recess 2112 defined at its bottom. The pin shaft 212 has a ball head with an insertion correspondingly received inside the upper recess 2111 of the holding base 211, wherein the insertion has two side stops 2121 longitudinally form on a periphery of the insertion to operationally abut the top of the holding base 211. The pin shaft 212 further has a distal end and a limiting ring 2122 attached at the distal end. The resilient element, such as a spring 213 as shown in the figures, sleeves around the insertion of the pin shaft 212 and is limited by the limiting ring 2122 inside the spring recess 2112 of the holding base 211.

When the pin shaft 212 is raised, the side stops 2121 disengage from the upper recess 2111 of the holding base 211. After rotating the pin shaft 212 90°, the insertion does not correspondingly align with the upper recess 2111 and the side stops 2121 thus rest on the top of the holding base 211 to keep the pin shaft 212 suspending on the holding base 211. Therefore, the pin shaft 212 disengages with the positioning hole 34 on the base 3 to make the rotating plate 2 movable.

In order to lock the rotating plate 2, the pin shaft 212 reversely rotates 90° to make the insertion correspondingly align with the upper recess 2111 of the holding base 211 again for inserting. The pin shaft 212 is pushed downward to automatically enter the upper recess 2111 by the resilient force provided from the spring 213, the distal end of the pin shaft 212 penetrates the through hole (a2) of the intermediate plate (a) to engage the positioning hole 34 on the base 3. Thereby, the rotating plate 2 is positioned.

Moreover, a bearing 33 is mounted on the central shaft 32 and combined to the rotating plate 2 so that the rotating plate 2 enables to rotate stably.

Figure 4:
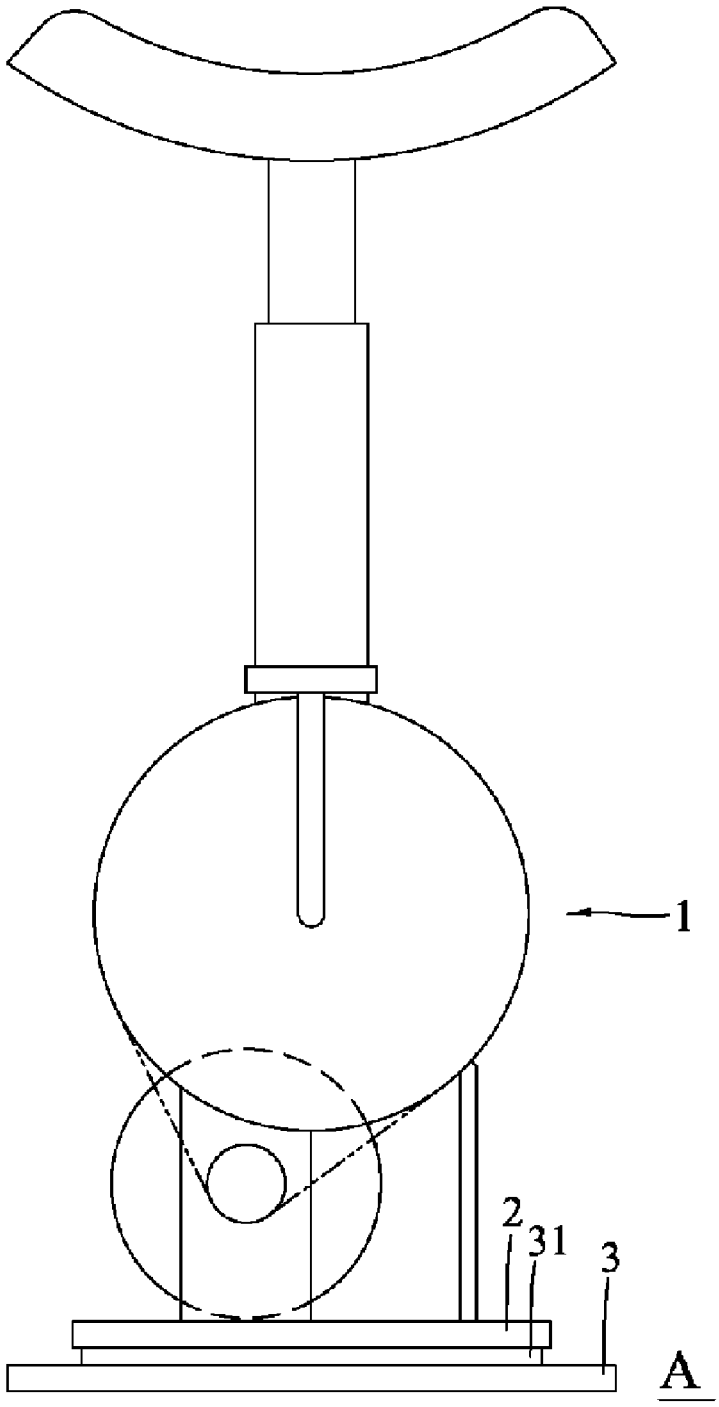
FIG. 4 is a partially cross-sectional side view of the pedaling exerciser with the twister device along line A-A in FIG. 3.
Figure 5:
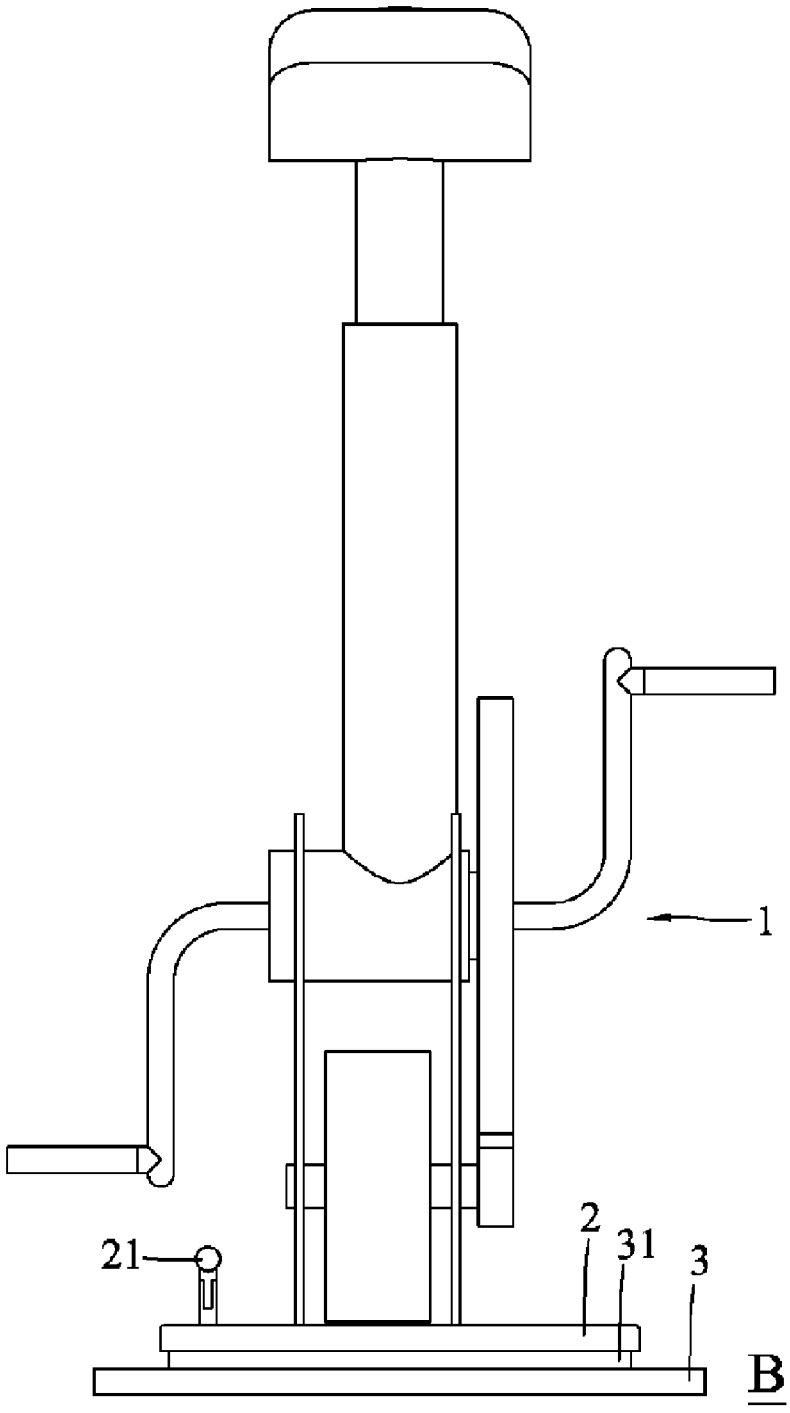
FIG. 5 is a partially cross-sectional view of the pedaling exerciser with the twister device along line B-B in FIG. 3.

With further reference to FIGS. 4 and 5, the pedaling assembly 1 is mounted on the rotating plate 2 and substantially composed of a bracket, an crank drum mounted on the bracket, a strength-adjusting drum mounted on the bracket below the crank drum, two cranks with pedals respectively attached to two sides of the crank drum and penetrating through the bracket, and a seat post erecting on the crank drum. The pedaling assembly 1 can be any available designs but has to be operable when the pedaling assembly 1 is mounted on the rotating plate 2. A shell 4 is mounted on the base 3 to cover the drums and the twister device to keep a user from touching the rotating drums and twister device. Moreover, a belt loops the crank drum and the strength-adjusting drum so that the strength-adjusting drum is driven by the crank drum when pedaling. Although a preferred embodiment of the pedaling assembly 1 is disclosed, various modifications of the pedaling are applicable in the present invention. Therefore, the pedaling assembly is not limited by this preferred embodiment.

Figure 6:
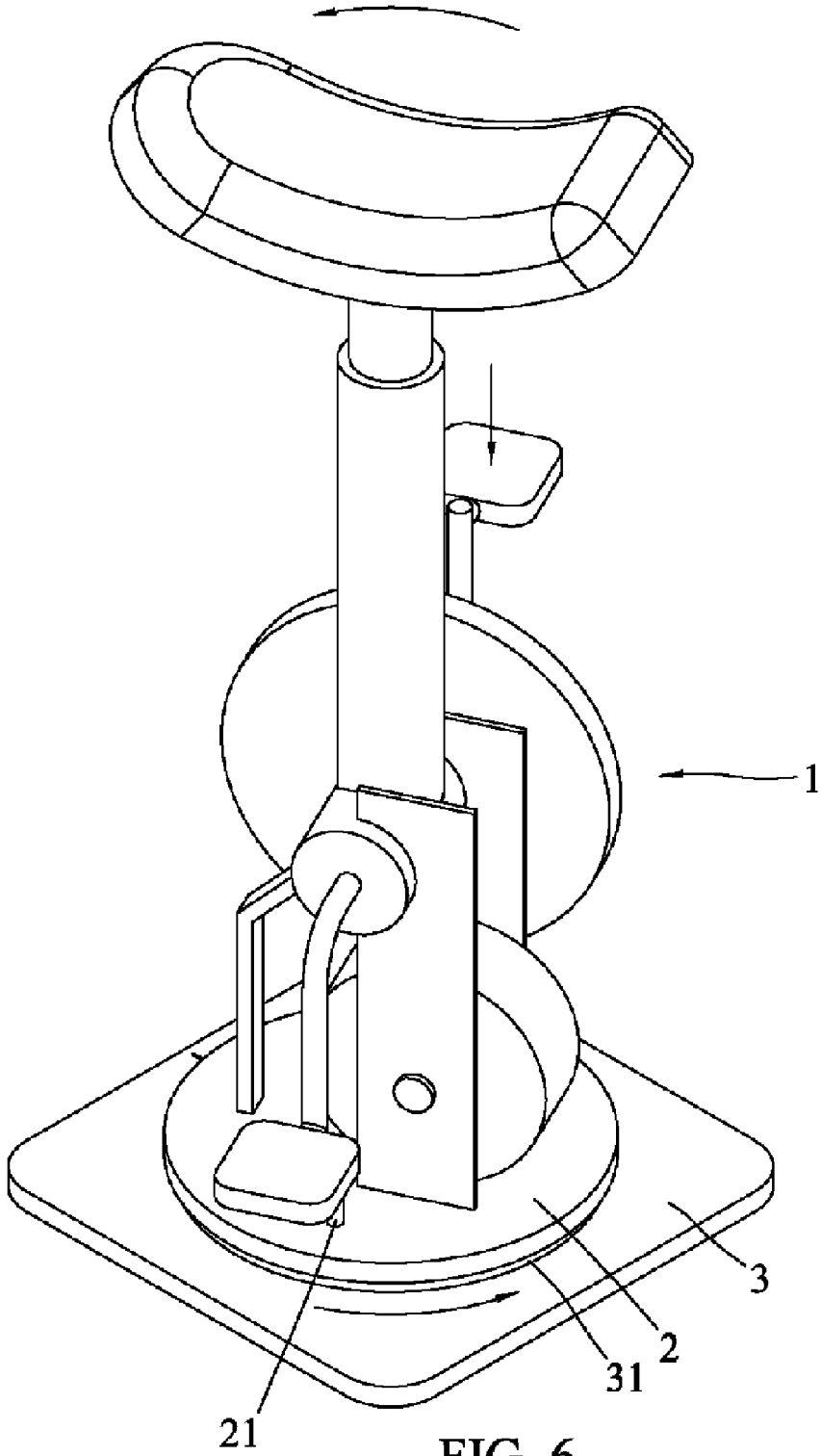
FIG. 6 is an operational perspective view of the pedaling exerciser with the twister device, wherein the pedaling exerciser rotates in counterclockwise rotation.
Figure 7:
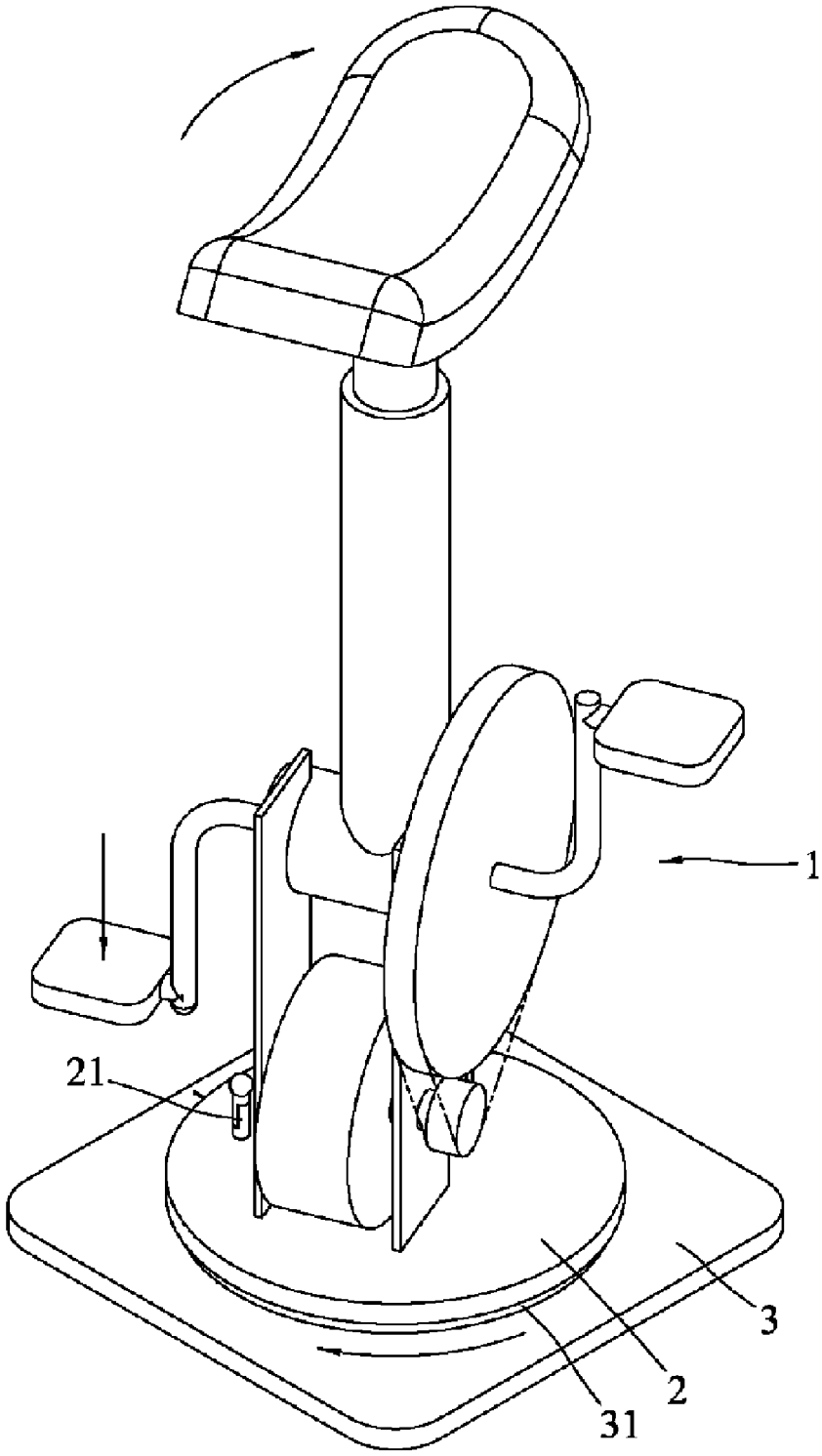
FIG. 7 is another operational perspective view of the pedaling exerciser with the twister device, wherein the pedaling exerciser rotates in clockwise rotation.

With reference to FIGS. 6 and 7, when the pedaling exerciser with the twister device is operated, the twister device is selectively locked or unlocked by pressing the pin assembly 21 downward or not. When the twister device is unlocked, the twister device rotates in harmony with the movement of the pedaling assembly 1. As shown in FIG. 6, when a user pushes the right pedal downward with the right foot, the body of the user slightly turns from right side to left side because the right foot has to be lifted so as to rotate the twister device in the counterclockwise direction. As shown in FIG. 7, when a user pushes the left pedal downward with the left foot, the body of the user slightly and reversely turns from left side to right side because the left foot has to be lifted so as to rotate the twister device in the clockwise direction. Thereby, the user exercises the waist at the same time when operating the pedaling assembly 1.

According to above description, the pedaling exerciser with the twister device in the present invention has the following advantages:

1. By combing the twister device, the pedaling exerciser further possesses a twisting function for training waists.
2. The bearing 33 mounted on the rotating plate 2 improves rotating stability of the twister device.
3. The pedaling exerciser with the twister device can selectively have only pedaling function by engaging the pin assembly 31 with the intermediate plate (a).
4. The balls (a1) on the intermediate plate (a) facilitate the rotation of the twister device during pedaling movement.

Although this invention has been described in its preferred form with a certain degree of particularity, it is understood that the present invention of the preferred form has been made only by way of example and that numerous changes in the details of construction and the combination and arrangement of parts any be resorted to without departing from the spirit and scope of the invention.

What is claimed is:

1. A pedaling exerciser with a twister device, comprising:

a base having a top face, a circular sidewall formed on the top face to define a recess and a central shaft mounted on the top face within the circular sidewall;

the twister device mounted on the base and having an intermediate plate received in the recess and penetrated and secured by the central shaft of the base and having multiple balls rotatably mounted on the intermediate plate to serve as friction-reducing elements; and a rotating plate rotatably mounted on the intermediate plate and correspondingly engaged to the circular sidewall on the base;

a bearing attached to the central shaft on the base and combined to the rotating plate to make the rotating plate rotate stably relative to the base; and a pedaling assembly having a pair of pedals that rotate in a circular motion about a horizontal axis wherein the assembly is mounted on the rotating plate to drive the rotating plate to rotate.

2. The pedaling exerciser with a twister device as claimed in claim 1, wherein the twister device rotates in 360° rotation.

3. The pedaling exerciser with a twister device as claimed in claim 1, wherein the rotating plate further has a pin assembly movably engageable to the base to lock and unlock the twister device to the base.

4. The pedaling exerciser with a twister device as claimed in claim 1, wherein the rotating plate has a bottom face, at least one circular track formed on the bottom face of the rotating plate and a shallow concave groove defined on a distal end of the at least one circular track of the rotating plate;

the base further has at least one circular track formed on the top face to align with the at least one circular track on the rotating plate and further has a shallow concave groove defined on a distal end of the at least one circular track of the base.

5. The pedaling exerciser with a twister device as claimed in claim 1, wherein the pedaling exerciser further has a shell, mounted on the base, covering a lower portion of the pedaling assembly and the twister device.

6. The pedaling exerciser with a twister device as claimed in claim 3, wherein the pin assembly comprises:

a holding base mounted on the rotating plate and having a top, a bottom, an upper recess defined at the top and a spring recess defined at the bottom; and a pin shaft having a ball head with an insertion correspondingly received inside the upper recess of the holding base, wherein the insertion has two side stops formed on a periphery of the insertion.

7. The pedaling exerciser with a twister device as claimed in claim 6, wherein the pin shaft further comprises a distal end and a limiting ring;

wherein, the pin assembly further comprises a resilient element sleeving around the insertion of the pin shaft and limited by the limiting ring inside the spring recess of the holding base.

* * * * *